United States Patent [19]

Kuo

[11] 4,041,095

[45] Aug. 9, 1977

[54] METHOD FOR UPGRADING $C_3$ PLUS PRODUCT OF FISCHER-TROPSCH SYNTHESIS

[75] Inventor: James C. Kuo, Cherry Hill, N.J.

[73] Assignee: Mobil Oil Corporation, New York, N.Y.

[21] Appl. No.: 614,582

[22] Filed: Sept. 18, 1975

[51] Int. Cl.[2] ..... C07C 1/04

[52] U.S. Cl. ..... 260/676 R; 208/79; 208/88; 208/93; 208/120; 208/135; 260/449 R; 260/450

[58] Field of Search ..... 260/676 R, 449 R, 449 M, 260/449.5, 449.6, 450; 208/57, 64, 79, 88, 93

[56] References Cited

U.S. PATENT DOCUMENTS

| | | | |
|---|---|---|---|
| 2,740,804 | 4/1956 | Glazier | 260/450 |
| 2,752,382 | 6/1956 | Garrett et al. | 260/450 |
| 3,172,842 | 3/1965 | Paterson | 208/79 |
| 3,700,585 | 10/1972 | Chen et al. | 208/111 |
| 3,729,409 | 4/1973 | Chen | 208/135 |
| 3,843,510 | 10/1974 | Morrison et al. | 208/111 |
| 3,928,483 | 12/1975 | Chang et al. | 260/668 R |

OTHER PUBLICATIONS

Asinger, Paraffins Chemistry & Technology, Pergammon Press, N.Y., (1968), pp. 3, 123–125, 131, 132, 136, 138.

*Primary Examiner*—C. Davis

*Attorney, Agent, or Firm*—Charles A. Huggett; Carl D. Farnsworth

[57] ABSTRACT

A combination process is provided which upgrades the $C_3$ to 650° F product of Fischer-Tropsch Synthesis to form gasoline product of improved octane rating by contact with ZSM-5 crystalline zeolite and hydrogenation of light fuel oil to improve its stability and color characteristics. Gaseous products are converted to alkylate in the gasoline boiling range. The yield of light fuel oil may be increased by reducing the end point of the gasoline fraction to about 320° F.

3 Claims, 1 Drawing Figure

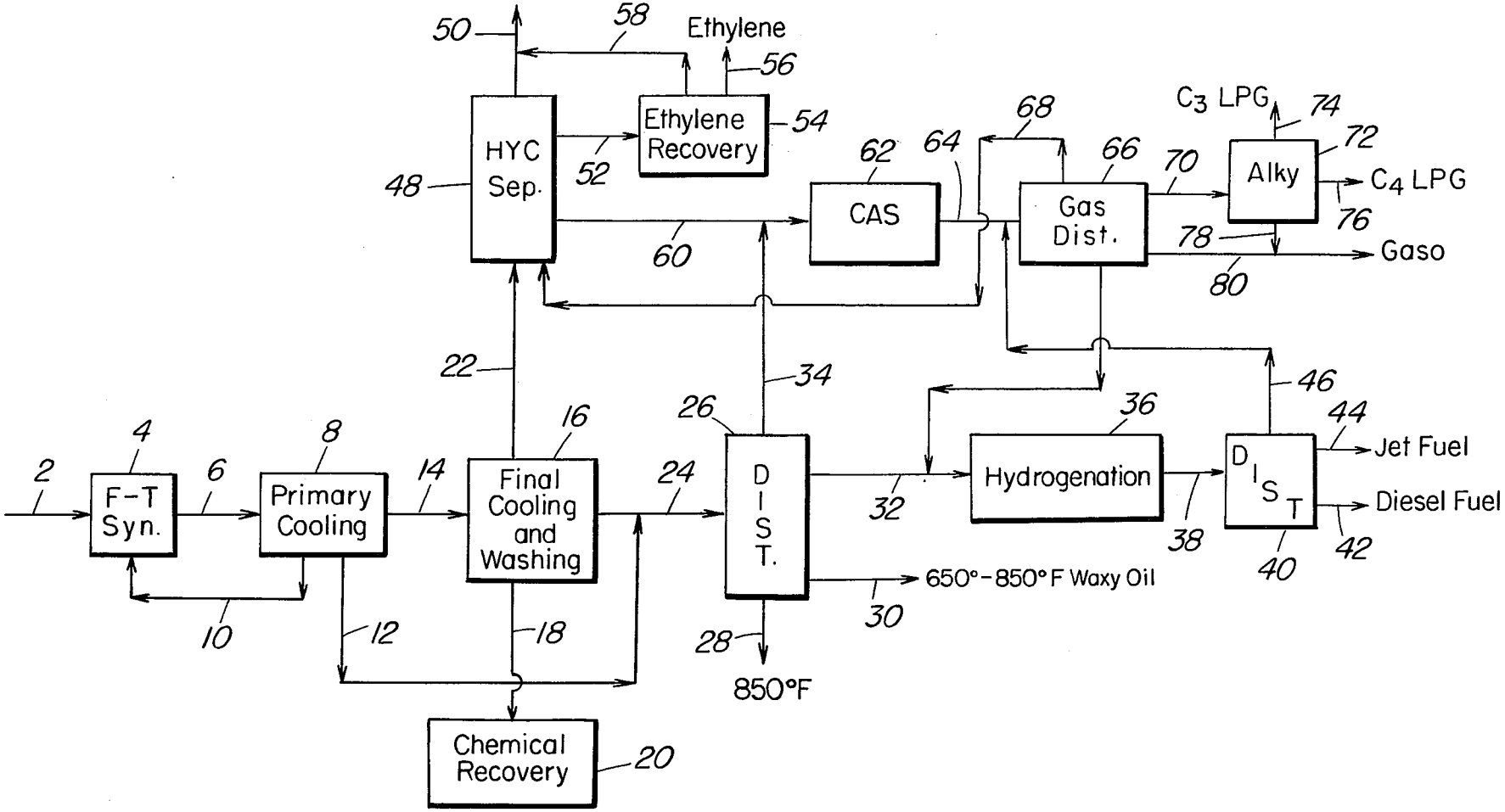
F-T Syn.
Primary Cooling
Final Cooling and Washing
Chemical Recovery
HYC Sep.
Ethylene Recovery
Ethylene
CAS
Gas Dist.
Alky
C3 LPG
C4 LPG
Gaso
DIST.
850°F
650°-850°F Waxy Oil
Hydrogenation
DIST
Jet Fuel
Diesel Fuel
2
4
6
8
10
12
14
16
18
20
22
24
26
28
30
32
34
36
38
40
42
44
46
48
50
52
54
56
58
60
62
64
66
68
70
72
74
76
78
80

METHOD FOR UPGRADING $C_3$ PLUS PRODUCT OF FISCHER-TROPSCH SYNTHESIS

BACKGROUND OF THE INVENTION

This invention is concerned with a method or processes for converting synthesis gas, such as mixtures of gaseous carbon oxides with hydrogen or hydrogen donors to form hydrocarbon mixtures and oxygenates. The invention is concerned with an arrangement of processing steps for increasing the yields of high octane gasoline boiling components and light oil material suitably for use as diesel fuel over that obtained heretofore in the known Fischer-Tropsch synthesis gas conversion process. In still another aspect, this invention is concerned with the use of a novel class of crystalline zeolites represented by ZSM-5 crystalline zeolite for improving the product distribution obtained from a Fischer-Tropsch synthesis gas conversion operation.

The worlds largest oil from coal producing plant is known as the Sasol project in South Africa where petroleum products and chemicals are produced from high ash bituminous coal. The Sasol project works two variations of the Fischer-Tropsch synthesis gas conversion operation using a fixed and fluid catalyst bed system. This Seasol project has been described in British Chemical Engineering for the months May, June and July 1957. One portion of these articles of particular interest is concerned with the product recovery that is discussed in the July 1957 article.

The Sasol project referred to above and built to convert an abundant supply of coal to hydrocarbons, oxygenates and chemicals was a pioneering venture. The process complex developed is enormous by any standard and quite expensive to operate. Therefore any advances which can be made to improve the yield of desired products without significantly increasing operating expense is viewed as one of major importance. The processing concepts of this invention are considered to fall in that category.

OTHER PRIOR ART

Processes for the conversion of coal and other hydrocarbons such as natural gas to a gaseous mixture consisting essentially of hydrogen and carbon monoxide, or of hydrogen and carbon dioxide, or of hydrogen and carbon monoxide and carbon dioxide, are well known. Although various processes may be employed for the gasification, those of major importance depend either on the partial combustion of the fuel with an oxygen-containing gas or on a combination of these two reactions. An excellent summary of the art of gas manufacture, including synthesis gas, from solid and liquid fuels, is given in Encyclopedia of Chemical Technology, Edited by Kirk-Othmer, Second Edition, Volume 10, pages 353–433, (1966), Interscience Publishers, New York, New York, the contents of which are herein incorporated by reference. The techniques for gasification of coal or other solid, liquid or gaseous fuel are not considered to be per se inventive here.

It is considered desirable to effectively and more efficiently convert synthesis gas, and thereby coal and natural gas, to highly valued hydrocarbons such as motor gasoline with high octane number, petrochemical feedstocks, liquefiable petroleum fuel gas, and aromatic hydrocarbons. It is well known that synthesis gas will undergo conversion to form reduction products of carbon monoxide, such as hydrocarbons, at from about 300° F to about 850° F under from about one to one thousand atmospheres pressure, over a fairly wide variety of catalysts. The Fisher-Tropsch process, for example, which has been most extensively studied, produces a range of products including liquid hydrocarbons, a portion of which have been used as low octane gasoline. The types of catalysts that have been studied for this and related processes include those based on metals or oxides of iron, cobalt, nickel, ruthenium, thorium, rhodium and osmium.

The wide range of catalysts and catalysts modifications disclosed in the art and an equally wide range of conversion conditions for the reduction of carbon monoxide by hydrogen provide considerable flexibility toward obtaining selected boiling-range products. Nonetheless, in spite of this flexibility, it has not proved possible to make such selections so as to produce liquid hydrocarbons in the gasoline boiling range which contain highly branched paraffins and substantial quantities of aromatic hydrocarbons, both of which are required for high quality gasoline, or to selectively produce aromatic hydrocarbons particularly rich in the benzene to xylenes range. A review of the status of this art is given in "Carbon Monoxide-Hydrogen Reactions", Encyclopedia of Chemical Technology, Edited by Kirk-Othmer, Second Edition, Volume 4, pp. 446–488, Interscience Publishers, New York, N.Y., the text of which is incorporated herein by reference.

SUMMARY OF THE INVENTION

This invention directed to a method and combination of processing steps for altering the product distribution of a Fisher-Tropsch synthesis gas conversion operation. In a particular aspect the present invention relates to processing the hydrocarbon product of Fischer-Tropsch synthesis comprising $C_3$ and higher boiling hydrocarbons to improve the characteristics of synthetic gasoline comprising yield, stability and octane rating. In addition the invention is concerned with improving the stability and color characteristics as well as yield of a light fuel oil product of the process boiling up to about 650° F.

The combination operation of this invention is concerned with separating the hydrocarbon product of Fischer-Tropsch synthesis following water wash thereof to products boiling below about 650° F. into a light fuel oil product, gasoline boiling product and gaseous components suitable for catalytic upgrading to form gasoline and light fuel oil boiling components. In a particular aspect, the present invention is concerned with upgrading synthetic gasoline with respect to octane rating by processing hydrocarbon components comprising $C_3$ and higher boiling hydrocarbons in the gasoline boiling range over a special class of crystalline zeolites represented by ZSM-5 crystalline zeolite. In another aspect, the present invention is concerned with improving the yield of the light fuel oil product of the process.

The special zeolite catalysts referred to herein utilize members of a special class of zeolites exhibiting some unusual properties. These zeolites induce profound transformations of aliphatic hydrocarbons to aromatic hydrocarbons in commercially desirable yields and are generally highly effective in alkylation, isomerization, disproportionation and other reactions involving aromatic hydrocarbons. Although they have unusually low alumina contents, i.e., high silica to alumina ratios, they are very active even with silica to alumina ratios exceeding 30. This activity is surprising since catalytic activity of zeolites is generally attributed to framework aluminum atoms and cations associated with these aluminum atoms. These zeolites retain their crystallinity for long periods in spite of the presence of steam even at high temperatures which induce irreversible collapse of the crystal framework of other zeolites, e.g. of the X and A type. Furthermore, carbonaceous deposits, when formed, may be removed by burning at higher than usual temperatures to restore activity. In many environments, the zeolites of this class exhibit very low coke forming capability, conductive to very long times on stream between burning regenerations.

An important characteristic of the crystal structure of this class of zeolites is that it provides constrained access to, and egress from, the intra-crystalline free space by virtue of having a pore dimension greater than about 5 Angstroms and pore windows of about a size such as would be provided by 10-membered rings of oxygen atoms. It is to be understood, of course, that these rings are those formed by the regular disposition of the tetrahedra making up the anionic framework of the crystalline aluminosilicate, the oxygen atoms themselves being bonded to the silicon or aluminum atoms at the centers of the tetrahedra. Briefly, the preferred zeolites useful as catalysts in this invention possess, in combination: a silica to alumina ratio of at least about 12; and a structure providing constrained access to the crystalline free space.

The silica to alumina ratio referred to may be determined by conventional analysis. This ratio is meant to represent, as closely as possible, the ratio in the rigid anionic framework of the zeolite crystal and to exclude aluminum in the binder or in cationic or other form within the channels. Although zeolites with a silica to alumina ratio of at least 12 are useful, it is preferred to use zeolites having higher ratios of at least about 30. Such zeolites, after activation, acquire an intracrystalline sorption capacity for normal hexane which is greater than that for water, i.e., they exhibit "hydrophobic" properties. It is believed that this hydrophobic character is advantageous in the present invention.

The zeolites useful as catalysts in this invention freely sorb normal hexane and have a pore dimension greater than about 5 Angstroms. In addition, their structure must provide constrained access to some larger molecules. It is sometimes possible to judge from a known crystal structure whether such constrained access exists. For example, if the only pore windows in a crystal are formed by 8-membered rings of oxygen atoms, then access by molecules of larger cross-section than normal hexane is substantially excluded and the zeolite is not of the desired type. Zeolites with windows of 10-membered rings are preferred, although excessive puckering or pore blockage may render these zeolites substantially ineffective. Zeolites with windows of 12-membered rings do not generally appear to offer sufficient constraint to produce the advantageous conversions desired in the instant invention, although structures can be conceived, due to pore blockage or other cause, that may be operative.

Rather than attempt to judge from crystal structure whether or not a zeolite possesses the necessary constrained access, a simple determination of the "constraint index" may be made by continuously passing a mixture of equal weight of normal hexane and 3-methylpentane over a small sample, approximately 1 gram or less, of zeolite at atmospheric pressure according to the following procedure. A sample of the zeolite, in the form of pellets or extrudate, is crushed to a particle size about that of coarse sand and mounted in a glass tube. Prior to testing, the zeolite is treated with a stream of air at 1000° F for at least 15 minutes. The zeolite is then flushed with helium and the temperature adjusted between 550° F and 950° F to give an overall conversion between 10% and 60%. The mixture of hydrocarbons is passed at 1 liquid hourly space velocity (i.e., 1 volume of liquid hydrocarbon per volume of catalyst per hour) over the zeolite with a helium dilution to give a helium to total hydrocarbon mole ratio of 4:1. After 20 minutes on stream, a sample of the effluent is taken and analyzed, most conveniently by gas chromatography, to determine the fraction remaining unchanged for each of the two hydrocarbons.

The "constraint index" is calculated as follows:

$$\text{Constraint Index} = \frac{\log_{10}}{\log_{10}} \frac{\text{(fraction of n-hexane remaining)}}{\text{(fraction of 3-methylpentane remaining)}}$$

The constraint index approximates the ratio of the cracking rate constants for the two hydrocarbons. Catalysts suitable for the present invention are those which employ a zeolite having a constraint index from 1.0 to 12.0. Constraint Index (CI) values for some typical zeolites including some not within the scope of this invention are:

| CAS | C.I. |
|---|---|
| ZSM-5 | 8.3 |
| ZSM-11 | 8.7 |
| ZSM-35 | 4.5 |
| TMA Offretite | 3.7 |
| ZSM-12 | 2 |
| ZSM-38 | 2 |
| Beta | 0.6 |
| ZSM-4 | 0.5 |
| Acid Mordenite | 0.5 |
| REY | 0.4 |
| Amorphous Silica-alumina | 0.6 |
| Erionite | 38 |

The above-described Constraint Index is an important and even critical, definition of those zeolites which are useful to catalyze the instant process. The very nature of this parameter and the recited technique by which it is determined, however, admit of the possibility that a given zeolite can be tested under somewhat different conditions and thereby have different constraint indexes. Constraint Index seems to vary somewhat with severity of operation (conversion). Therefore, it will be appreciated that it may be possible to so select test conditions to establish multiple constraint indexes for a particular given zeolite which may be both inside and outside the above defined range of 1 to 12.

Thus, it should be understood that the "Constraint Index" value as used herein is an inclusive rather than an exclusive value. That is, a zeolite when tested by any combination of conditions within the testing definition set forth herein above to have a constraint index of 1 to 12 is intended to be included in the instant catalyst definition regardless that the same identical zeolite tested under other defined conditions may give a constraint index value outside of 1 to 12.

The class of zeolites defined herein is exemplified by ZSM-5, ZSM-11, ZSM-12, ZSM-21, ZSM-35, ZSM-38 and other similar material. Recently issued U.S. Pat.

No. 3,702,886 describing and claiming ZSM-5 is incorporated herein by reference.

ZSM-11 is more particularly described in U.S. Pat. No. 3,709,979, the entire contents of which are incorporated herein by reference.

ZSM-12 is more particularly described in U.S. Pat. No. 3,832,449, the entire contents of which are incorporated herein by reference.

U.S. Application, Ser. No. 358,192, filed May 7, 1973, and now abandoned, the entire contents of which are incorporated herein by reference, describes a zeolite composition, and a method of making such, designated as ZSM-21 which is useful in this invention.

U.S. Application Ser. No. 528,061 filed Nov. 29, 1974, the entire contents of which are incorporated herein by reference, describes a zeolite composition including a method of making it. This composition is designated ZSM-35 and is useful in this invention.

U.S. Application Ser. No. 528,060, filed Nov. 29, 1974, and now abandoned, the entire contents of which are incorporated herein by reference, describes a zeolite composition including a method of making it. This composition is designated ZSM-38 and is useful in this invention.

The X-ray diffraction pattern of ZSM-21 appears to be generic to that of ZSM-35 and ZSM-38. Either or all of these zeolites is considered to be within the scope of this invention.

The specific zeolites described, when prepared in the presence of organic cations, are substantially catalytically inactive, possibly because the intracrystalline free space is occupied by organic cations from the forming solution. They may be activated by heating in an inert atmosphere at 1000° F for 1 hour, for example, followed by base exchange with ammonium salts followed by calcination at 1000° F in air. The presence of organic cations in the forming solution may not be absolutely essential to the formation of this special type zeolite; however, the presence of these cations does appear to favor the formation of this special type of zeolite. More generally, it is desirable to activate this type zeolite by base exchange with ammonium salts followed by calcination in air at about 1000° F for from about 15 minutes to about 24 hours.

Natural zeolites may sometimes be converted to this type zeolite by various activation procedures and other treatments such as base exchange, steaming, alumina extraction and calcination, alone or in combinations. Natural minerals which may be so treated include ferrierite, brewsterite, stilbite, dachiardite, epistilbite, heulandite and clinoptilolite. The preferred crystalline aluminosilicates are ZSM-5, ZSM-11, ZSM-12 and ZSM-21, with ZSM-5 particularly preferred.

The zeolites used as catalysts in this invention may be in the hydrogen form or they may be base exchanged or impregnated to contain ammonium or a metal cation complement. It is desirable to calcine the zeolite after base exchange. The metal cations that may be present include any of the cations of the metals of Groups I through VIII of the periodic table. However, in the case of Group IA metals, the cation content should in no case be so large as to substantially eliminate the activity of the zeolite for the catalysis being employed in the instant invention. For example, a completely sodium exchanged H-ZSM-5 appears to be largely inactive for shape selective conversions required in the present invention.

In a preferred aspect of this invention, the zeolites useful as catalysts herein are selected as those having a crystal framework density, in the dry hydrogen form, of not substantially below about 1.6 grams per cubic centimeter. It has been found that zeolites which satisfy all three of these criteria are most desired. Therefore, the preferred catalysts of this invention are those comprising zeolites having a constraint index as defined above of about 1 to 12, a silica to alumina ratio of at least about 12 and a dried crystal density of not substantially less than about 1.6 grams per cubic centimeter. The dry density for known structures may be calculated from the number of silicon plus aluminum atoms per 1000 cubic Angstroms, as given, e.g., on page 19 of the article on Zeolite Structure by W. M. Meier. This paper, the entire contents of which are incorporated herein by reference, is included in "Proceedings of the Conference on Molecular Sieves, London, April, 1967" published by the Society of Chemical Industry, London, 1968. When the crystal structure is unknown, the crystal framework density may be determined by classical pyknometer techniques. For example, it may be determined by immersing the dry hydrogen form of the zeolite in an organic solvent which is not sorbed by the crystal. It is possible that the unusual sustained activity and stability of this class of zeolites is associated with its high crystal anionic framework density of not less than about 1.6 grams per cubic centimeter. This high density of course must be associated with a relatively small amount of free space within the crystal, which might be expected to result in more stable structures. This free space, however, seems to be important as the locus of catalytic activity.

Crystal framework densities of some typical zeolites including some which are not within the purview of this invention are:

| Zeolite | Void Volume | Framework Density |
|---|---|---|
| Ferrierite | 0.28 cc/cc | 1.76 g/cc |
| Mordenite | .28 | 1.7 |
| ZSM-5, -11 | .29 | 1.79 |
| Dachiardite | .32 | 1.72 |
| L | .32 | 1.61 |
| Clinoptilolite | .34 | 1.71 |
| Laumontite | .34 | 1.77 |
| ZSM-4 (Omega) | .38 | 1.65 |
| Heulandite | .39 | 1.69 |
| P | .41 | 1.57 |
| Offretite | .40 | 1.55 |
| Levynite | .40 | 1.54 |
| Erionite | .35 | 1.51 |
| Gmelinite | .44 | 1.46 |
| Chabazite | .47 | 1.45 |
| A | .5 | 1.3 |
| Y | .48 | 1.27 |

The drawing is a diagrammatic sketch in elevation of a block flow arrangement of processing steps for improving the products of Fischer-Tropsch synthesis boiling below about 650° F.

Referring now to the drawing, a synthesis gas fuel comprising oxides of carbon and hydrogen is introduced to a Fischer-Tropsch synthesis reaction zone or section 4 by conduit 2. Products of the Fischer-Tropsch synthesis operation comprising hydrocarbon and oxygenates and relatively high boiling waxy materials are passed by conduit 6 to a first cooling operation referred to as a primary cooling zone 8. In the primary cooling zone 8, a separation is made to recover a slurry oil fraction withdrawn by conduit 10 which is recycled to the Fischer-Tropsch synthesis section 4; a decant oil fraction usually boiling above about 400° F is withdrawn by conduit 12 and a hydrocarbon stream boiling below about 560° F withdrawn by conduit 14. The rough separation made in the primary cooling section 8 at a temperature within the range of about 280° to 400° F will alter to some extent the cut point of the portions withdrawn by conduits 12 and 14. The material boiling below about 560° F withdrawn by conduit 14 and including liquid and vaporous material is passed to a final cooling and wash section represented by zone 16. In zone 16, the products of Fischer-Tropsch synthesis charged thereto are washed with sufficient water, with/or without caustic, to remove oxygenates therein. The washed oxygenates are recovered and withdrawn by conduit 18 for passage to a chemical recovery section. It is contemplated processing all or a portion of these recovered oxygenates to produce desired chemicals or they may be converted to hydrocarbons by contact with the special zeolite catalyst herein defined. In yet another embodiment it is contemplated recovering the lower alcohols from the oxygenates and processing all or a portion thereof over the special zeolite catalyst either alone or in combination with gasoline boiling range material separated from the Fischer-Tropsch effluent. Non hydrocarbon products recovered from the effluent of a typical Fischer-Tropsch synthesis operation have been identified as provided in the following table.

Table

ESTIMATED PRODUCTION OF ORGANIC CHEMICALS

| | Estimated Production lb./yr. |
|---|---|
| Acetaldehyde | 9,100,000 |
| Propionaldehyde | 1,930,000 |
| n-Butyraldehyde | 2,750,000 |
| Acetone | 11,200,000 |
| Methanol | 730,000 |
| Methyl ethyl ketone | 4,780,000 |
| Ethanol | 63,680,000 |
| n-Propyl alcohol | 14,400,000 |
| n-Butyl alcohol | 4,370,000 |
| n-Amyl alcohol | 1,060,000 |
| Acetic acid | 24,700,000 |
| Propionic | 8,700,000 |
| Butyric acid | 4,200,000 |
| Methyl propyl ketone | 600,000 |
| Total | 152,200,000 |

In zone 16 a separation is also made to recover $C_6$ and lower boiling components withdrawn by conduit 22 from high boiling hydrocarbons comprising $C_5$ and higher boiling hydrocarbons withdrawn by conduit 24.

The decant oil fraction in conduit 12 is mixed with the $C_5$ plus fraction in conduit 24 and passed to a distillation section represented by zone 26. On the other hand the materials in conduits 12 and 25 may be separately passed to the distillation section 26 for separation as hereinafter discussed.

In distillation section 26 a separation is made of the washed hydrocarbons charged thereto to recover a heavy 850° F plus product from the bottom of the tower by conduit 28, a heavy waxy oil boiling generally in the range of 600° or 650° F up to about 850° F withdrawn by conduit 30, a light fuel oil product withdrawn by conduit 32 boiling below about 650° F and a gasoline boiling fraction withdrawn by conduit 34. In this distillation operation it is contemplated varying the cut point between the gasoline boiling fraction and the light fuel oil fraction within the range of about 320° F up to about 400° F. Thus when it is desired to maximize the yield of light fuel oil product, a cut point as low as about 320° or 330° F is made and when maximizing the yield of gasoline product a higher cut point is selected above 360° F and up to about 430° F.

The light fuel oil product selected and obtained as above provided and withdrawn by conduit 32 is passed to a hydrogenation zone 36 wherein hydrogenation of the fuel oil charge is accomplished under conditions improving the color and stability of the product fuel oil. Generally the temperature employed may be within the range of 500° to 800° F at a hydrogen pressure selected from within the range of 200 to 1000 psig. A catalyst suitable for the mild hydrogenation operation of zone 36 is cobalt molybdenum or nickel molybdenum on alumina or any other hydrogenation catalyst known in the art and suitable for the purpose. The hydrogenated light fuel oil product is withdrawn by conduit 38 for passage to a distillation zone 40. In distillation zone 40, a separation is made to recover a diesel fuel product withdrawn by conduit 42, a jet fuel product withdrawn by conduit 44 and a lower boiling product of hydrogenation withdrawn by conduit 46.

The $C_6$ and lower boiling materials separated from final cooling section 16 and withdrawn by conduit 22 are passed to a hydrocarbon separation section represented by zone 48. In zone 48 a separation is made to recover $C_2$ minus materials withdrawn by conduit 50 from a $C_2$ rich fraction passed by conduit 52 to an ethylene recovery section or zone 54. Ethylene product is recovered by conduit 56 with other $C_2$ material withdrawn by conduit 58 communicating with conduit 50. A $C_3$ to $C_6$ synthesis product fraction is withdrawn by conduit 60 and passed to zone 62 containing a mass of the special crystalline zeolite catalyst herein identified. In addition gasoline boiling range material recovered by conduit 34 from distillation zone 26 is also passed to the crystalline zeolite conversion zone 62. Upgrading of gasoline boiling components along with $C_3$ and higher boiling gaseous material is accomplished with the special crystalline zeolite catalyst herein identified at a temperature selected from within the range of 450° to 950° F and a pressure within the range of 0 to 300 psig. In this operation a synthetic gasoline of Fischer-Tropsch synthesis is raised from about 55 octane up to about 90 octane. Furthermore components lower boiling than benzene are converted to components in the gasoline boiling range of relatively high octane rating. The upgraded product of crystalline aluminosilicate conversion is passed by conduit 64 to a gasoline distillation zone 66. In distillation zone 66 a separation is made to recover $C_2$ minus material which is withdrawn and passed by conduit 68 to separation section 48. A $C_3$ to $C_4$ gaseous fraction or alkylation rich feed stream is withdrawn and conveyed by conduit 70 to an alkylation operation in zone 72. The alkylation operation may be one relying upon sulfuric acid or it may be an HF alkylation unit. In the alkylation section a separation is also made for the recovery of unreacted $C_3$ and $C_4$ components withdrawn by conduits 74 and 76 respectively. Alkylate product in the gasoline boiling range is received by conduit 78 for admixture if desired with gasoline product recovered from distillation 66 by conduit 80. On the other hand each of the gasoline components in conduits 78 and 80 may be separately passed to gasoline blending not shown. In distillation zone 66 a separation is made with respect to the gasoline end point to either maximize the yield of gasoline product or reduce the yield of gasoline in favor of increasing the light fuel oil yield. Thus the gasoline end point may be selected from within the range of about 320° F up to about 400° F. Thus in the event that material boiling above about 320° F is to be retained in the light fuel oil product this boiling range material separated in distillates zone 66 is withdrawn by conduit 82 for passage with the light oil material in conduit 32 to the hydrogenation zone 36.

The product stream of Fischer-Tropsch synthesis is characterized as one of high yields of olefins, mainly straight chain and terminal type olefins such as alpha olefins; moderate amounts of paraffins, mainly normal paraffins with some single methyl-branched isomers; moderate amounts of oxygenates including alcohols and acids and relatively large yields of propylene and butylene.

The gasoline product of a Fischer-Tropsch synthesis operation is usually low in octane number (about 50–65 R + O) and contains a considerable amount of organic acids. The crystalline zeolite catalyst herein-identified is relied upon to upgrade the synthetic Fischer-Tropsch synthesis naphtha or gasoline boiling materials by the following combination of product transformations; conversion of pentanes and heavier olefins to aromatics, paraffins (mainly branched isomers) and branched type olefins; isomerization of normal paraffins to isoparaffins; and conversion of oxygenates when retained in the naphtha into hydrocarbons comprising aromatics, isoparaffins and branched olefins. The gasoline product of the crystalline zeolite conversion operation is found to have an octane number in the range of 90 to 95 R + O and contains little if any organic acids. The crystalline zeolite catalyst herein defined also effects under selected operating conditions the conversion of propylene and butylene into gasoline boiling material comprising aromatics and paraffins (mostly isoparaffins) in high yield providing an octane rating in the range of 90–95 R + O.

Having thus generally described this invention and discussed specific examples pertaining thereto, it is to be understood that no undue restrictions are to be imposed by reason thereof except as defined by the following claims.

I claim:

1. In a process combination wherein the effluent of a Fischer-Tropsch synthesis operation is cooled and separated to provide a decant oil fraction, a liquid hydrocarbon fraction boiling below said decant oil, a gaseous hydrocarbon fraction and a water fraction, the method for improving the quality of the hydrocarbon fractions thus separated which comprises, recovery from said liquid hydrocarbon fractions, a first gasoline fraction, a waxy oil fraction boiling up to about 850° F, a fraction boiling above about 850° F and a light oil fraction boiling between said first gasoline fraction and said recovered waxy oil fraction, hydrogenating said light oil fraction and separating the hydrogenated product thereof to recover a diesel fuel product, a jet fuel boiling product and a lighter fraction boiling below said jet fuel, separating said gaseous hydrocarbon fraction recovered from the Fischer-Tropsch synthesis effluent under conditions to recover an ethylene rich stream from a stream comprising $C_3$ to $C_6$ hydrocarbons, combining said stream comprising $C_3$ to $C_6$ hydrocarbons with said separated first gasoline fraction and contacting the thus combined streams with a selective crystalline zeolite conversion catalyst under conditions to substantially raise the octane number of the gasoline charged thereto, separating the effluent of said crystalline zeolite conversion operation and said lighter fraction separated from said jet fuel under conditions to recover a higher octane gasoline boiling product fraction, a fraction comprising $C_3$ to $C_4$ hydrocarbons and a hydrocarbon fraction higher boiling than said higher octane gasoline fraction, passing the thus recovered higher boiling hydrocarbon fraction to said hydrogenation step, alkylating said fraction comprising $C_3$ to $C_4$ hydrocarbons to produce LPG product and gasoline boiling product and blending gasoline boiling product of said alkylation operation with said higher octane gasoline product.

2. The process of claim 1 wherein said first gasoline fraction is separated under conditions to provide an end boiling point within the range of 320° to 400° F.

3. The process of claim 1 wherein the water fraction of Fischer-Tropsch synthesis is passed to chemical processing.

* * * * *